US009751664B2

(12) United States Patent
Polt

(10) Patent No.: US 9,751,664 B2
(45) Date of Patent: Sep. 5, 2017

(54) LID WITH NOSE ACCOMMODATIONS

(71) Applicant: B. Robert Polt, Redmond, WA (US)

(72) Inventor: B. Robert Polt, Redmond, WA (US)

(73) Assignee: Ruumi Cup, Bellevue, WA (US)

( * ) Notice: Subject to any disclaimer, the term of this patent is extended or adjusted under 35 U.S.C. 154(b) by 0 days.

(21) Appl. No.: 15/099,245

(22) Filed: Apr. 14, 2016

(65) Prior Publication Data

US 2016/0229597 A1 Aug. 11, 2016

Related U.S. Application Data

(62) Division of application No. 13/874,471, filed on Apr. 30, 2013, now Pat. No. 9,340,333.

(60) Provisional application No. 61/742,747, filed on Aug. 17, 2012, provisional application No. 61/687,949, filed on May 5, 2012.

(51) Int. Cl.

| | |
|---|---|
| ***A47G 19/22*** | (2006.01) |
| ***B65D 43/02*** | (2006.01) |
| ***B65D 43/06*** | (2006.01) |

(52) U.S. Cl.

CPC ..... *B65D 43/0227* (2013.01); *A47G 19/2272* (2013.01); *B65D 43/065* (2013.01); *B65D 2543/00046* (2013.01); *B65D 2543/00092* (2013.01); *B65D 2543/00296* (2013.01)

(58) Field of Classification Search

CPC ..... B65D 43/0227; B65D 43/065; B65D 2543/00046; B65D 2543/00296; B65D 2543/00092; A47G 19/2272

USPC ..... 220/826–828, 254.2, 254.3, 254.5, 713, 220/717, 719; 229/404, 906.1; 215/21, 215/24

See application file for complete search history.

(56) References Cited

U.S. PATENT DOCUMENTS

| | | | | |
|---|---|---|---|---|
| 1,167,791 | A * | 1/1916 | Boothe | B65D 49/02 215/24 |
| 4,776,478 | A * | 10/1988 | Miller | B65F 1/1607 220/254.5 |
| 4,986,437 | A | 1/1991 | Farmer | |
| 6,079,586 | A * | 6/2000 | Hanneman | B65D 43/0212 206/217 |
| 6,419,105 | B1 | 7/2002 | Bruce | |
| 6,419,112 | B1 | 7/2002 | Bruce et al. | |

(Continued)

*Primary Examiner* — James N Smalley

(74) *Attorney, Agent, or Firm* — McCarter & English, LLP

(57) ABSTRACT

Lids with nose accommodations configured to reduce the need for a consumer to tilt his or her head during consumption of a beverage. In one aspect, a lid assembly includes a pivotable flap that pivots relative to a lid (and beverage container) as the container is tilted toward the beverage consumer. The configuration of the lid is such that it creates a clearance for a consumer's nose, thus enabling the container to be tilted back further without impacting the consumer's nose. In another configuration, the pivotable flap is biased toward a closed position, but is easily displaced by the consumer's nose. In another lid configuration, a cavity is formed toward a rear portion and the lid is sized and shaped to accommodate a consumer's nose. Disposable lids are also provided, including a lid with an aperture toward the rear of the lid with a cover that may be peeled back or removed and a lid with a perforated floor that is configured to enable the consumer to create a flap and/or aperture toward the rear of the lid.

17 Claims, 16 Drawing Sheets

(56) References Cited

U.S. PATENT DOCUMENTS

| | | | | |
|---|---|---|---|---|
| 6,578,726 | B1 | 6/2003 | Schaefer | |
| 2005/0205588 | A1 | 9/2005 | Pitts | |
| 2006/0226147 | A1* | 10/2006 | Phillips ..... | A47G 21/106<br>220/254.2 |
| 2008/0011762 | A1 | 1/2008 | Boone | |
| 2010/0301048 | A1 | 12/2010 | Tokunaga | |
| 2013/0020338 | A1 | 1/2013 | French et al. | |
| 2013/0037558 | A1 | 2/2013 | Selina et al. | |
| 2014/0042178 | A1 | 2/2014 | Brannock | |

* cited by examiner

LID WITH NOSE ACCOMMODATIONS

This is a Divisional of application Ser. No. 13/874,471, filed Apr. 30, 2013, which claims benefit of Provisional Application Nos. 61/742,747 filed on Aug. 17, 2012 and 61/687,949, filed on May 5, 2012, the entirety of which are incorporated herein by reference.

CROSS-REFERENCE TO RELATED APPLICATION

This application claims the benefit of the filing dates of U.S. Provisional Application No. 61/687,949, filed May 5, 2012, entitled "TRAVEL MUG LID WITH NOSE CLEARING FLAP" and U.S. Provisional Application No. 61/742,747, filed Aug. 17, 2012, entitled "LID WITH NOSE OPENING under 35 U.S.C. §119(e). Additionally, each of Application Nos. 61/687,949 and 61/742,747 are incorporated herein in their entirety for all purposes.

FIELD OF THE INVENTION

The field of invention relates generally to beverage containers and, more specifically but not exclusively relates to lids for beverage cups, mugs and the like.

BACKGROUND INFORMATION

The popularity of coffee shops and the beverages they serve has seen tremendous growth in the past thirty years. In places such as a city's downtown area, there are often several coffee shops within the same block. Coffee stores such as Starbuck are ubiquitous in many large cities, from Seattle to Boston. In addition to national chains, various areas of the country also have their local favorites. Of course, there are also many fast food restaurant and/or specialty food chains that also serve large amounts of coffee, such as Dunkin Donuts, McDonalds, Tony Horton, etc. Other beverages are also served in beverage containers typically referred to as "coffee cups," whether or not the beverage is actually coffee.

A high percentage of coffee purchased at the foregoing coffee shops, restaurants, etc., is served in disposable (or recyclable) cups with plastic lids. The lids are used so that customers can easily transport their purchased beverages without spilling them. However, unlike a regular open cup or mug, a lid on the top restricts drinking when the cup is tilted towards the drinker as the lid comes in contact with the drinker's nose. This causes the drinker to tilt his or her head backwards to allow more of the beverage to reach the drinking opening. As coffee is, in general, drunk in small sips, a drinker needs to tilt his head repeatedly and progressively more with each sip until the remaining portion of the coffee is consumed. This can be uncomfortable. It can also disturb a conversation, even if for a short moment, as eye contact is lost when the consumer head tilts backwards. In other situations, like when driving a vehicle, taking the eyes of the road can even be dangerous.

These lids generally have a skirt around the lid's periphery that is adapted to engage a top lip of the disposable cup. These lids typically have a generally circular body and may either be generally flat on top, or have a relieved portion such as presented in U.S. Pat. No. 4,589,569 to Clements. Another approach is disclosed in U.S. Pat. No. 6,889,859 to Leon. The solution proposed by Leon was to have a raised rim where the drinking opening, or spout, is located. The amount the spout is raised allows for different clearances for the nose and can reduce or eliminate tilting of the head. The disadvantages of this solution are: 1) because the drinking opening was raised relative to the level of the coffee in the container, more initial tilting of the mug is required; 2) the mug appearance can be negatively affected by the disproportionately large and uneven lid; and 3) it is less comfortable to use a taller mug as the arc a consumer's arm has to move around has a larger radius and simply controlling the drinking opening for drinking takes more eye-hand coordination.

In addition to the use of disposable cups and lids, many customers bring in their own containers or otherwise transfer coffee from a disposable cup to their own container. Stores such as Starbucks sell various types of containers that are sized to hold the same amount of beverage as their normal serving sizes, e.g., 12 oz., 16 oz., and 20 oz. The containers are typically mated with removable (e.g., screw-on) lids that include provisions of various sorts for opening and closing an orifice through with the beverage can be consumed.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views unless otherwise specified:

FIG. 3*a* is an underside view of the lid assembly, while

DETAILED DESCRIPTION

Figure 1A:
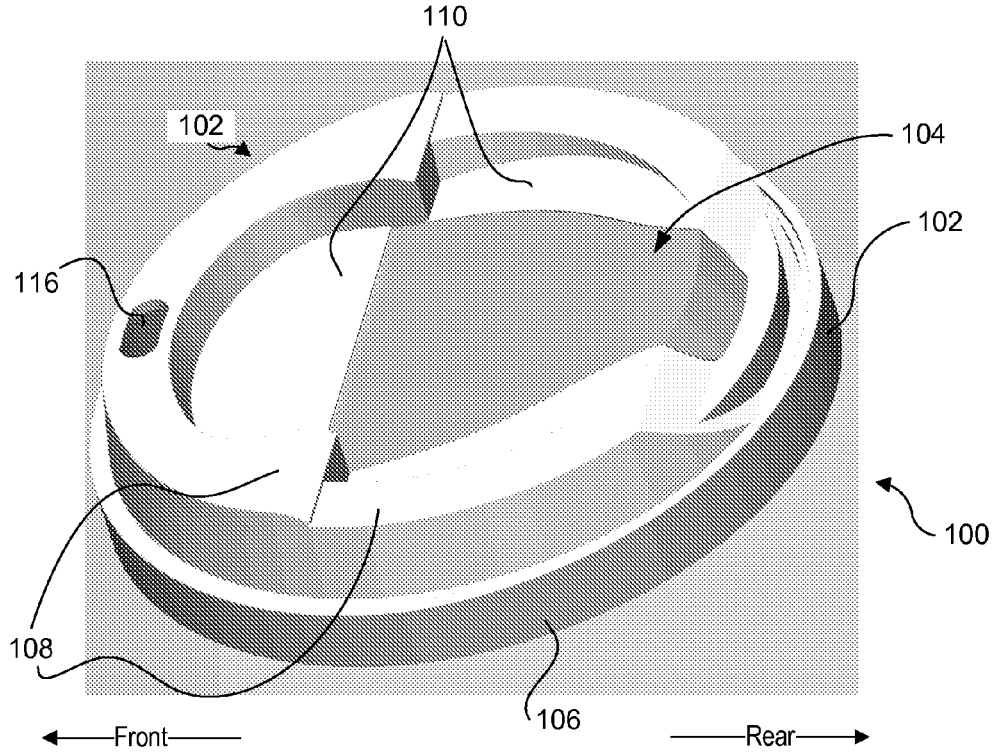
FIGS. 1*a* and 1*b* are topside isometric views of a lid assembly including a pivotable flap, according to one embodiment.

Embodiments of beverage container lids that enable drinkers to consume beverages in a manner that significantly reduces backward head tilting are described herein. In the following description, numerous specific details are set forth (such as for consuming beverages such as coffee) to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used herein in the detailed description and the claims, directional references such as front, rear, upward, downward, etc. may be made with reference to a lid assembly being upright and parallel to a horizontal surface or plane that is perpendicular to gravity. At the same time, the drawing figures herein present multiple views of the lid assembly and/or individual components thereof oriented and rotated relative to such a horizontal plane, including underside views. Accordingly, by way of example a component that is described as downward extending may be depicted as extending upward or in another direction in one or more of the drawing figures. It will be understood that any directional references in the description and claims correspond to the upright and horizontal configuration of the lid embodiments.

Figure 1B:
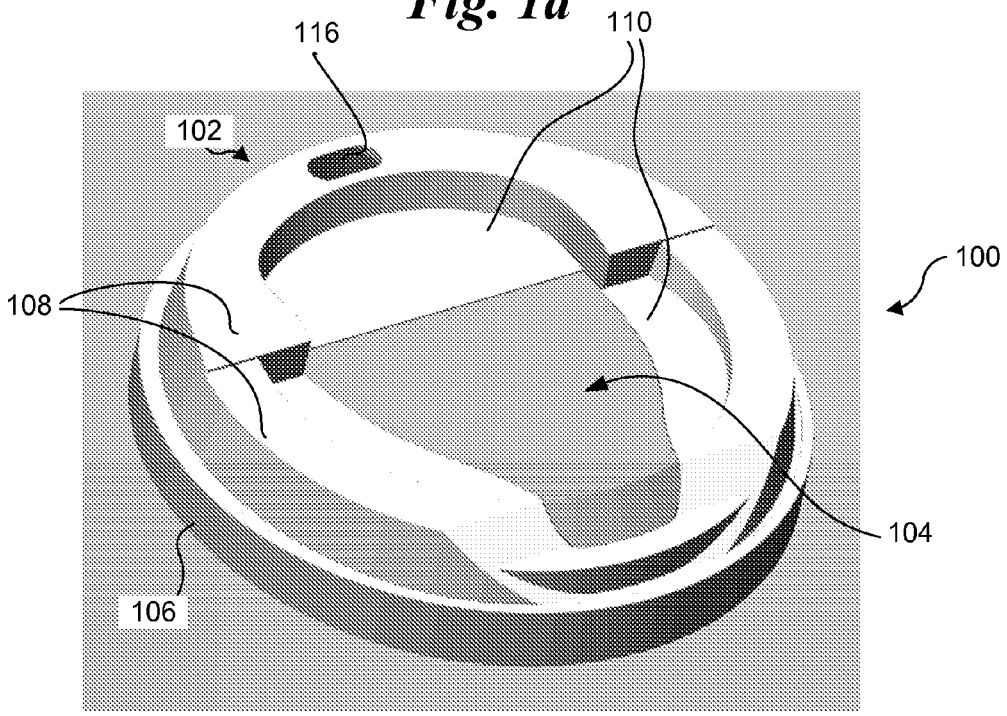
Figure 2A:
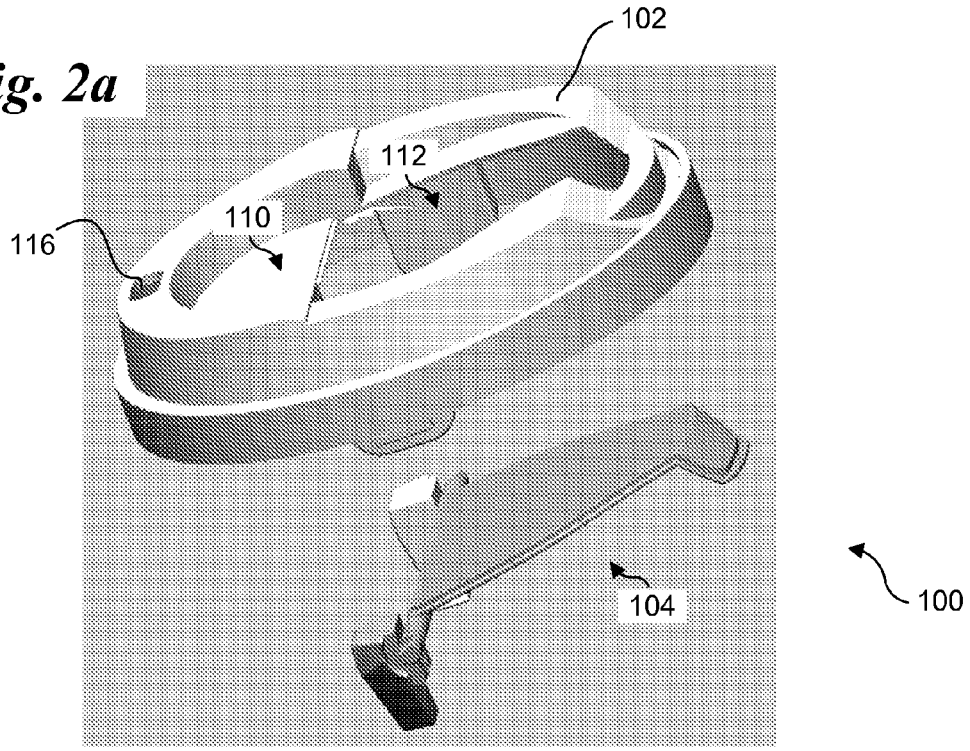
FIGS. 2*a* and 2*b* respectively show a topside and underside isometric exploded views of the lid assembly.
Figure 2B:
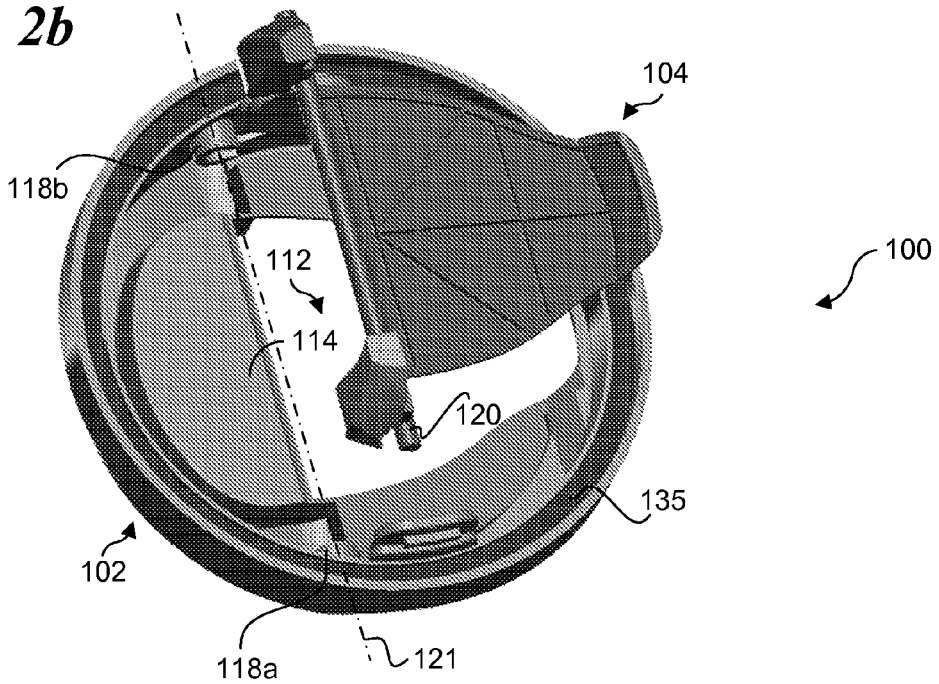
Figure 3A:
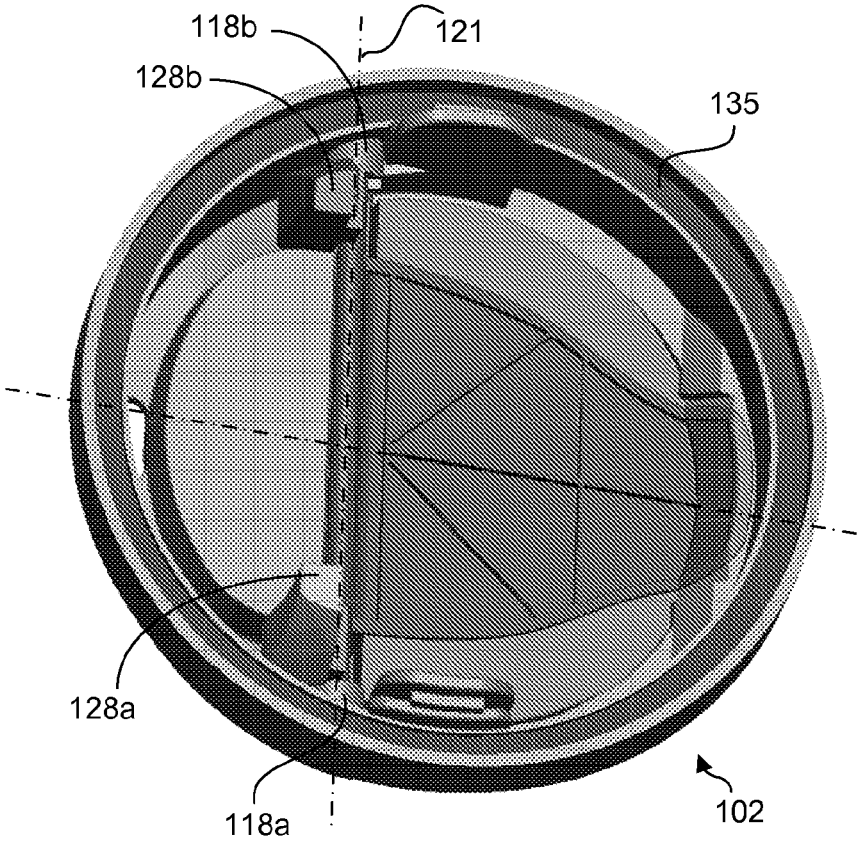
Figure 3B:
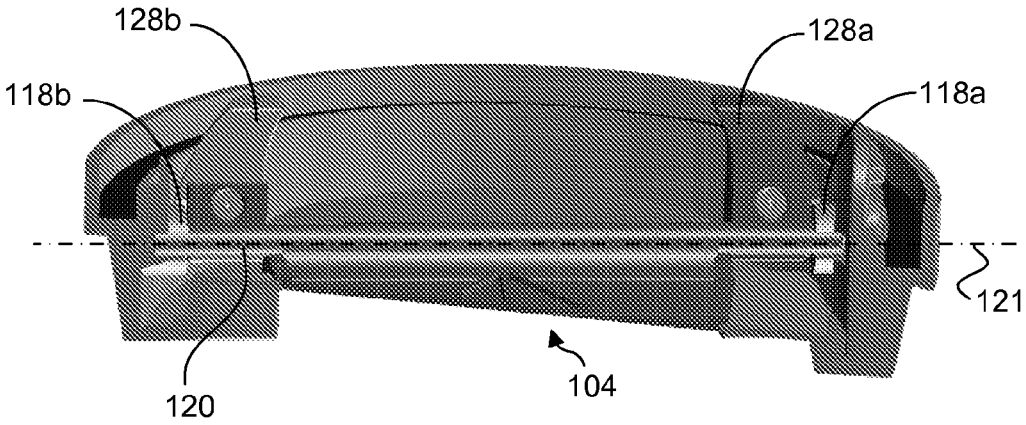
FIG. 3*b* shows a cross section view of the lid assembly detailing the pivot axis of the pivotable flap.
Figure 4A:
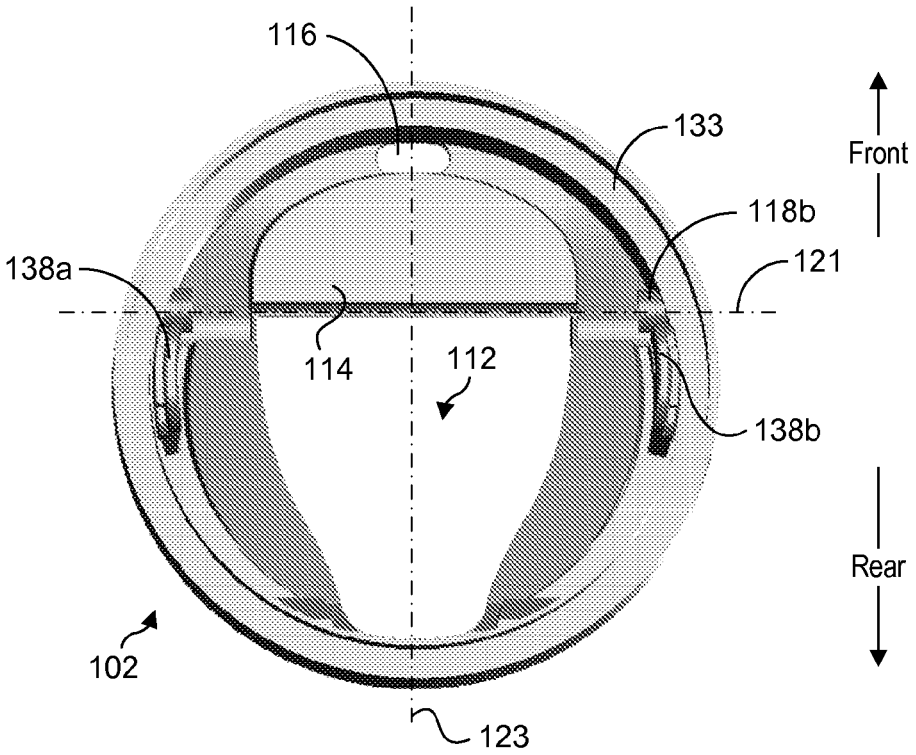
FIG. 4*a* is an underside view of the lid depicting the orientation of the drinking orifice, rear aperture, and pivot axis, according to one embodiment.

Various views of a lid assembly 100 according to a first embodiment are shown in FIGS. 1*a*, 1*b*, 2*a*, 2*b*, 3*a*, 3*b*, 4*a*, 4*b*, 5*a*, 5*b*, 6*a*, 6*b*, 8*a-d*, and 9*a-d*. For example, FIGS. 1*a* and 1*b* show topside isometric views of lid assembly 100 including a lid 102 with a pivoting flap 104 in a closed position, while FIGS. 2*a* and 2*b* respectively show a topside isometric exploded view and an underside isometric exploded view of lid assembly 100. In the illustrated embodiment and with reference to the lid assembly 100 being orientated in an upright, horizontal configuration, lid 102 includes a skirt 106 extending downward from a generally raised and plateaued area 108 formed around the periphery of the lid in which a well 110 is formed. As illustrated, in some embodiments that height of the raised area is reduced toward the rear of lid 102. As shown in FIGS. 2*a*, 2*b*, and 4*a*, an aperture 112 is formed in a rearward portion of well 110, leaving a shelf 114 in a frontal portion of the well. Lid 102 also includes an orifice 116 formed in the front portion of raised area 108 through which the beverage is consumed.

Figure 5A:
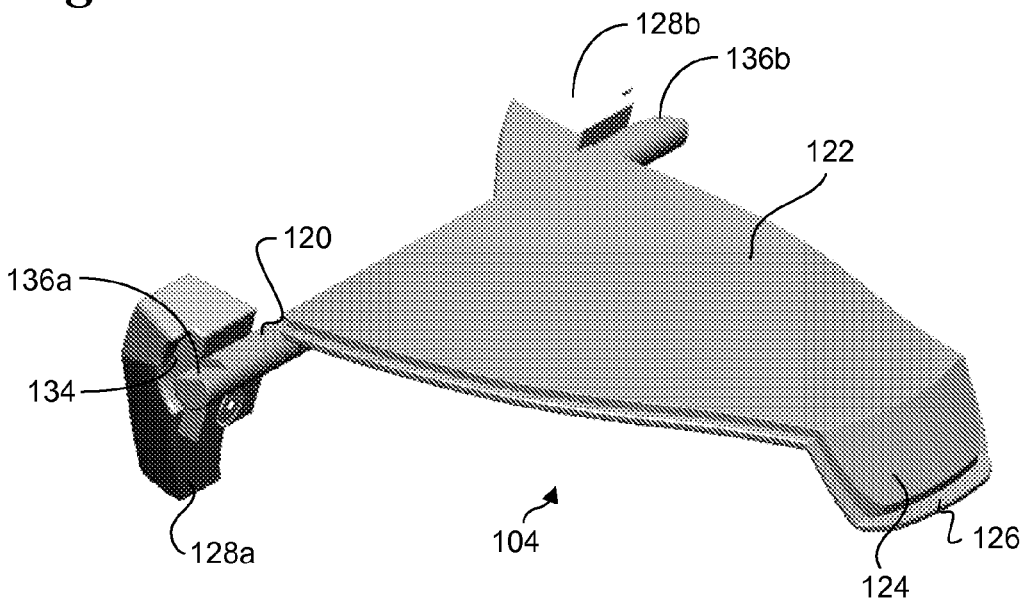
FIGS. 5*a* and 5*b* respectively show topside and underside isometric views of the pivotable flap, according to one embodiment.
Figure 5B:
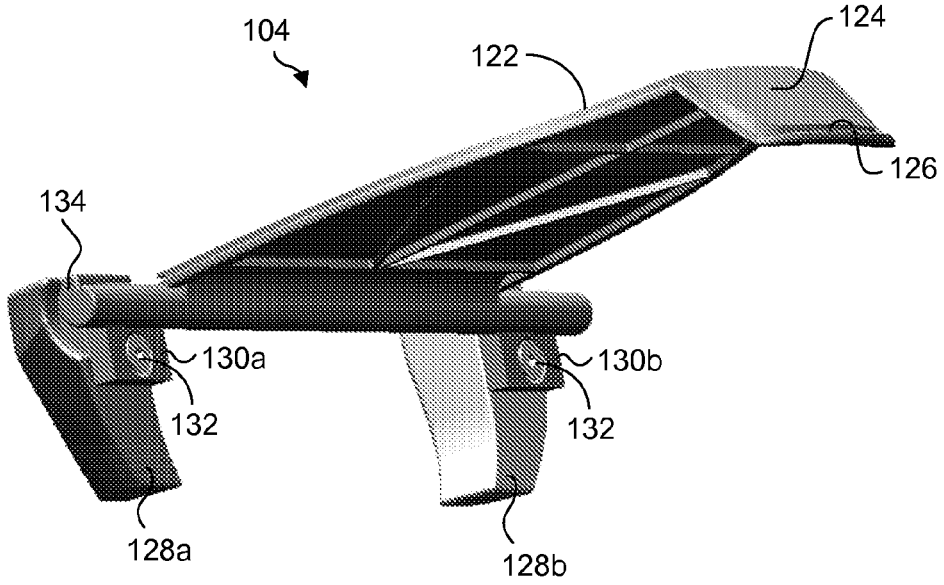

As shown in further detail in FIGS. 2*b*, 3*a*, 3*b*, and 4*a*, a pair of flap pivot mounts 118*a* and 118*b* are formed in the underside of lid 102. With further reference to FIGS. 5*a*, and 5*b*, each of the flap pivot mounts 118*a* and 118*b* are configured to receive a respective rod end portion of a pivot rod 120 of pivotable flap 104. As used herein, a rod end portion means that there is a portion of the pivot rod 120 that engages with a corresponding pivot mount that is located toward the end of the pivot rod but not necessarily at the end of the pivot rod (although it could be located at the end of a pivot rod). As shown in FIG. 4*a*, in one embodiment, a pivot axis 121 defined through pivot mounts 118*a* and 118*b* is substantially perpendicular to an axis 123 along a line of symmetry through orifice 116 and aperture 112.

Figure 4B:
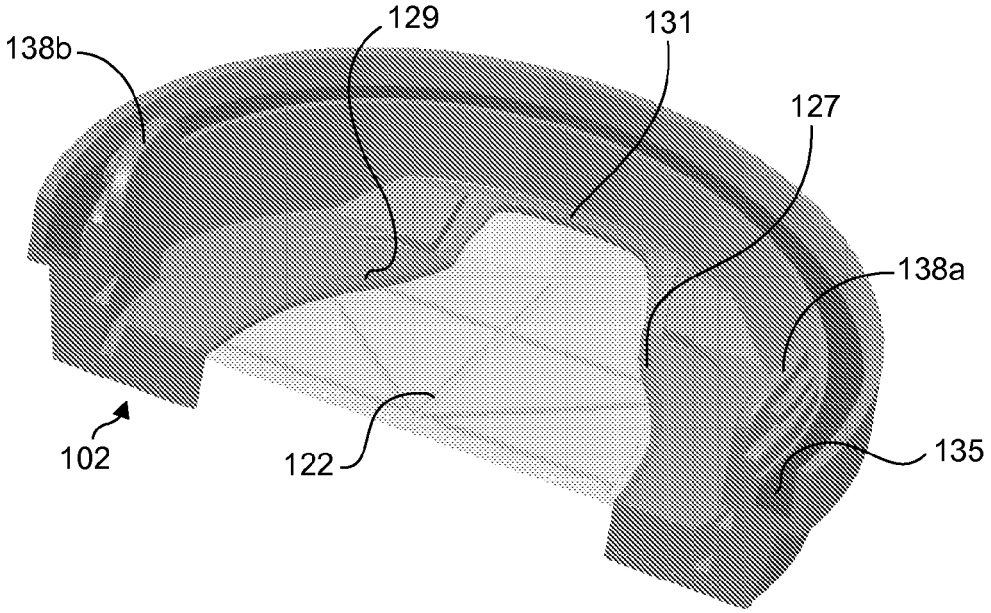
FIG. 4*b* is an isometric cross-section view depicting the engagement of the lip of the flap with the periphery of the aperture.

As shown in FIGS. 5*a* and 5*b*, pivotable flap 104 comprises a pivot rod 120 coupled to a cantilevered flap 122 having a downward extending tongue 124, with a lip 126 extending around the periphery of both the flap and the tongue. As shown in FIGS. 3*a* and 4*b*, in one embodiment, cantilevered flap 122 may be formed to include webbing or other type of strengthening structure, thus enabling the weight of the cantilevered portion of the flap to be reduced. Preferably, pivot rod 120 and cantilevered flap 122 will be formed as a single part and made from a material approved by the food industry for contact with beverages, such as various types of approved plastics.

In one embodiment shown in FIGS. 5*a* and 5*b*, a counterweight 128*a* is coupled to pivot rod 120 at a tab 130*a*. Similarly, a counterweight 128*b* is coupled to pivot rod 120 at a tab 130*b*. In the illustrated embodiment, two screws 132 are used to couple the counterweights to the tabs, thus effectively coupling the counterweight to pivot rod 120. In another embodiment, an adhesive or the like is used to couple the counterweights to the tabs. Optionally, other types of fastening means or coupling techniques may be employed. In yet another embodiment, pivotable flap 104 comprises a single-piece molded part in which a pair of counterweights are encapsulated. Also illustrated in FIGS. 5*a* and 5*b* are a clearance relief 134 on counterweight 128*a*, and a clearance flat 136*a* on pivot rod 120; a similar clearance relief is defined in counterweight 128*b* and a similar clearance flat 136*b* is formed at the opposite end of pivot rod 120.

Generally, counterweights 128*a* and 128*b* should be configured to counterbalance the moment created by cantilevered body 122 and tongue 124 about pivot axis 121 of pivot rod 120 due to gravity. In one embodiment, the flap assembly is configured such that its center of gravity is below and aligned (relative to gravity) with the pivot axis when the flap is in an open position, resulting in a stable equilibrium position. For example, such a configuration is shown in FIGS. 8*b* and 8*c* and described in further detail below. In addition, the counterweights can be designed to exert an upward pressure on the flap when the lid is in a horizontal position (relative to gravity) to force the flap closed. This result can be achieved by appropriately sizing the weight and horizontal arm of the counterweights weight so that the center of gravity 800 of the flap assembly 104 is biased toward the front of the lid relative to the pivot axes 121 when the flap is in the closed position and the lid is horizontal, as shown in FIG. 8*a*. Under this configuration, the flap will remain closed even when the lid is tilted at a small angle (e.g., less than 10-15 degrees). Preferably, the counterweights will be made of a high density material, such as a metal, that may be immersed in various liquids without contaminating the liquids and/or approved by the food industry. For example, materials such as stainless steel, brass, tungsten may be used, or steel plated with a non-corrosive material such as chrome or the like. Optionally, the counterweights may comprise a metal covered with a coating material approved by the food industry for use in beverage containers and the like. In one embodiment, the counterweights are molded with the cantilevered flap and pivot rod to form a single-piece assembly.

Figure 6A:
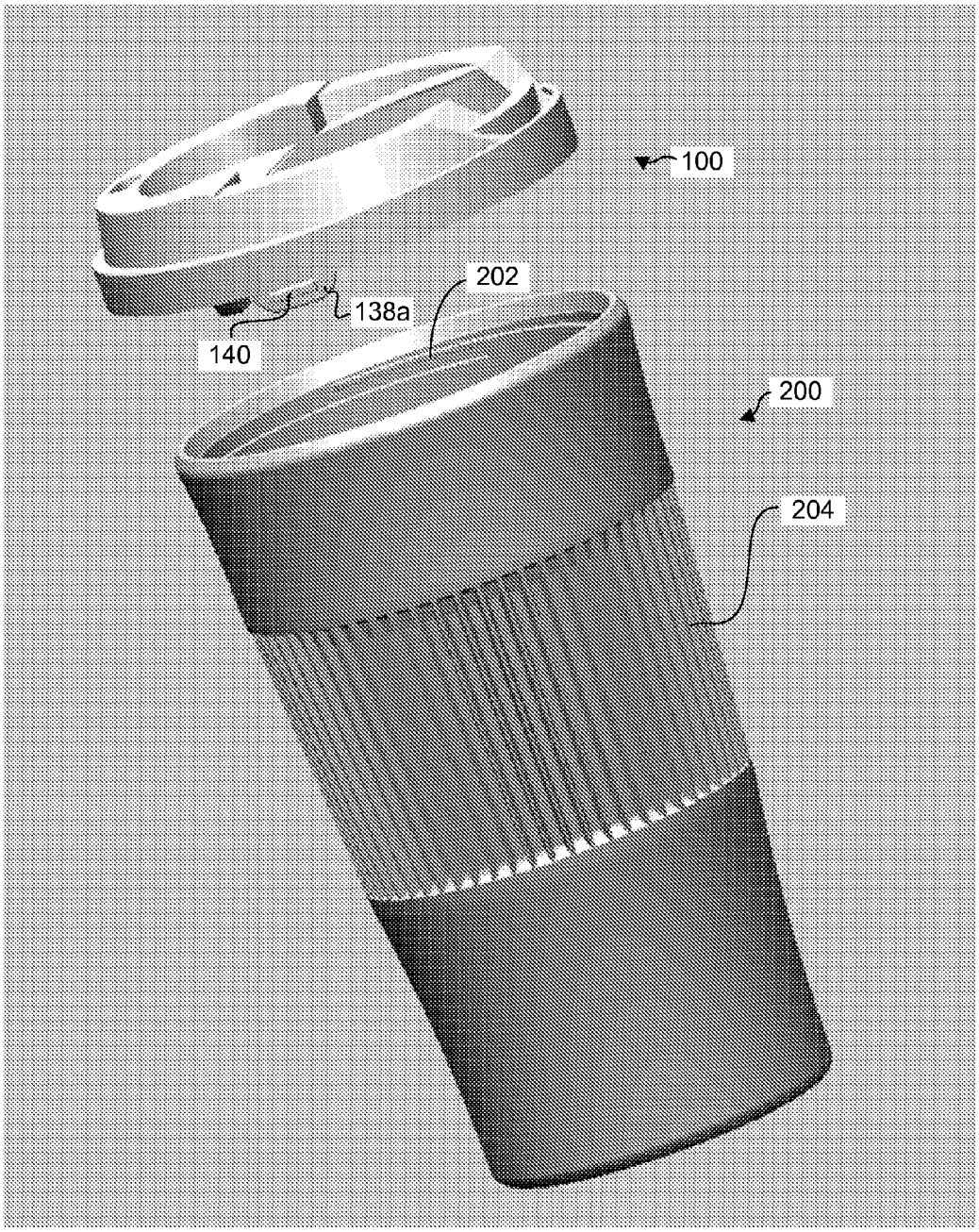
FIG. 6*a* is an exploded view illustrating a lid assembly and a beverage container to which the lid assembly is configured to be attached.
Figure 6B:
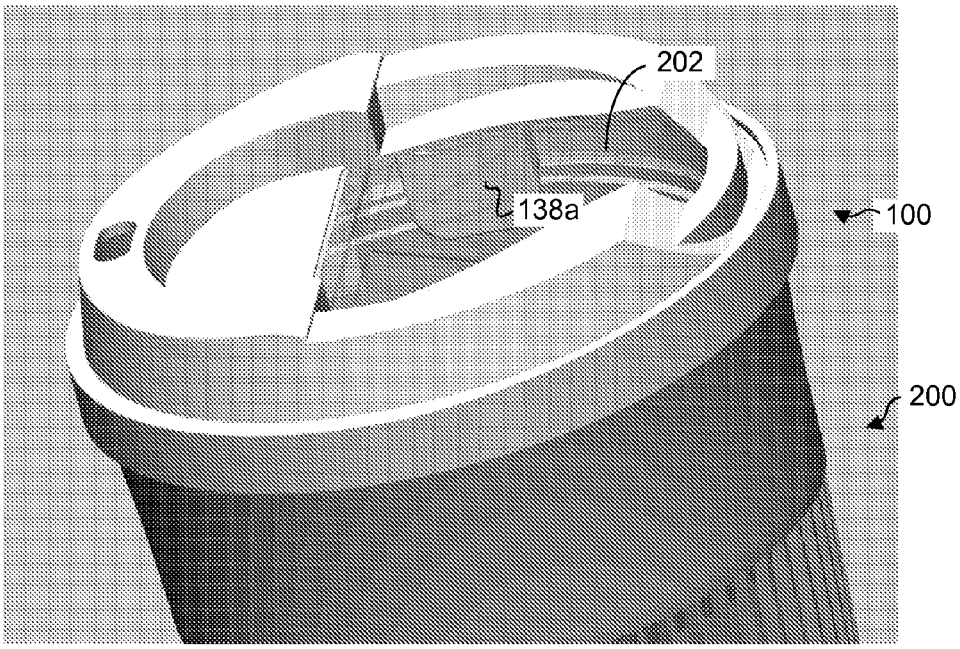
FIG. 6*b* is an isometric view illustrating the engagement of the lid with a thread disposed toward the top of the beverage container.
Figures 9A, 9B, 9C:
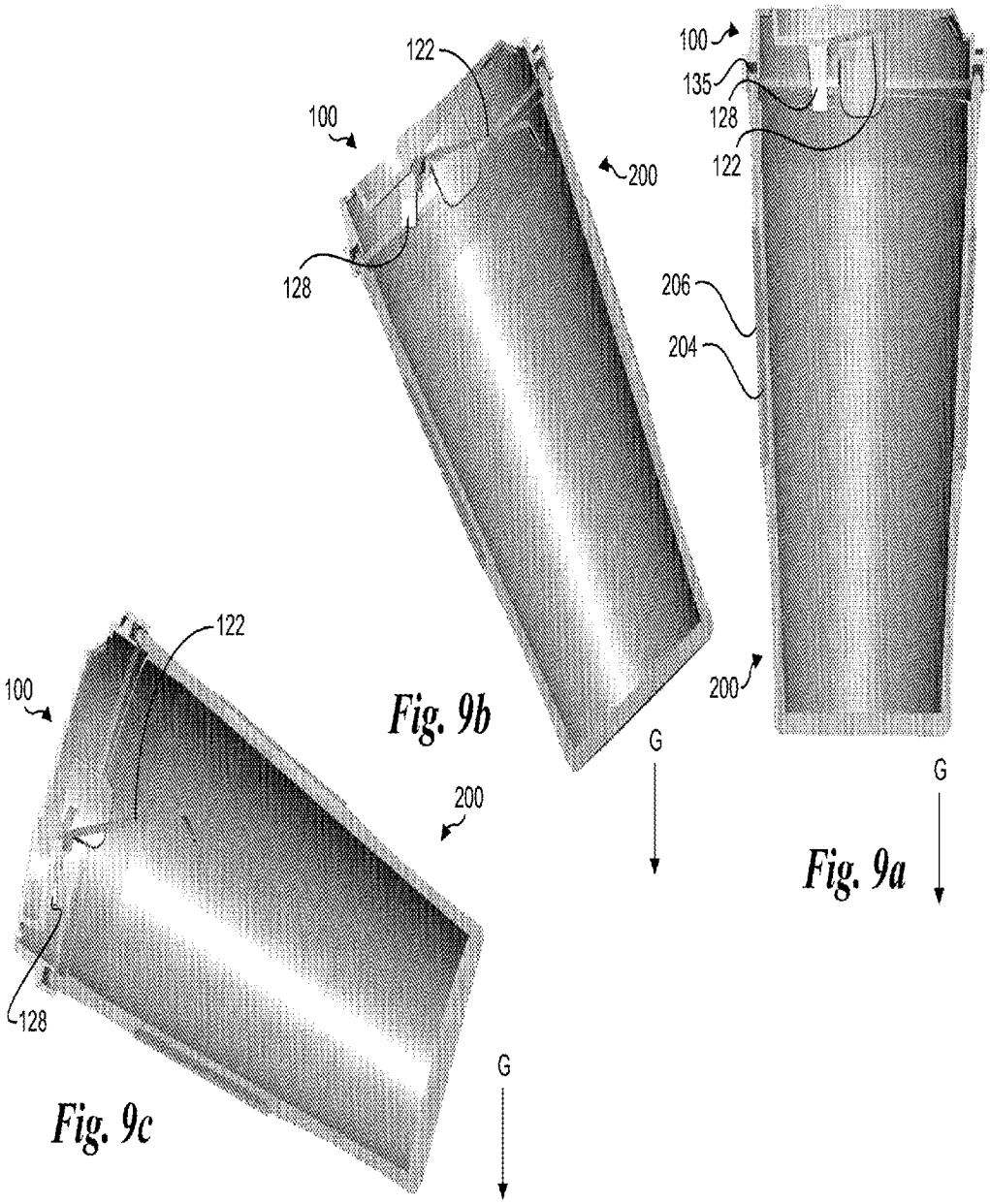
FIGS. 9*a*, 9*b*, and 9*c* are cross-section views illustrating the orientation of the pivotable flap relative to the lid and beverage container as the beverage container is tilted toward the consumer.

Further details of the underside of lid 102 are shown in FIGS. 4*a* and 4*b*. As illustrated, aperture 112 and cantilevered flap 122 are configured such that lip 126 (shown in FIGS. 5*a* and 5*b*) engages along the sides 127 and 129 and rear 131 of the periphery of the aperture. With further reference to FIGS. 6*a* and 6*b*, lid 102 includes a pair of downward extending tabs 138*a* and 138*b*, each with a protrusion 140 that is configured to engage within a thread 202 formed in an upper portion of a container 200. Accordingly, lid 102 may be screwed onto the top of container 200. In one embodiment, an annular groove 133 is defined in the underside of lid 102 and an annular lid gasket 135 is installed in the groove. As shown in FIGS. 9*a-c*, this configuration provides an additional seal between lid 102 and container 200 when the lid is screwed onto the container.

Figure 7A:
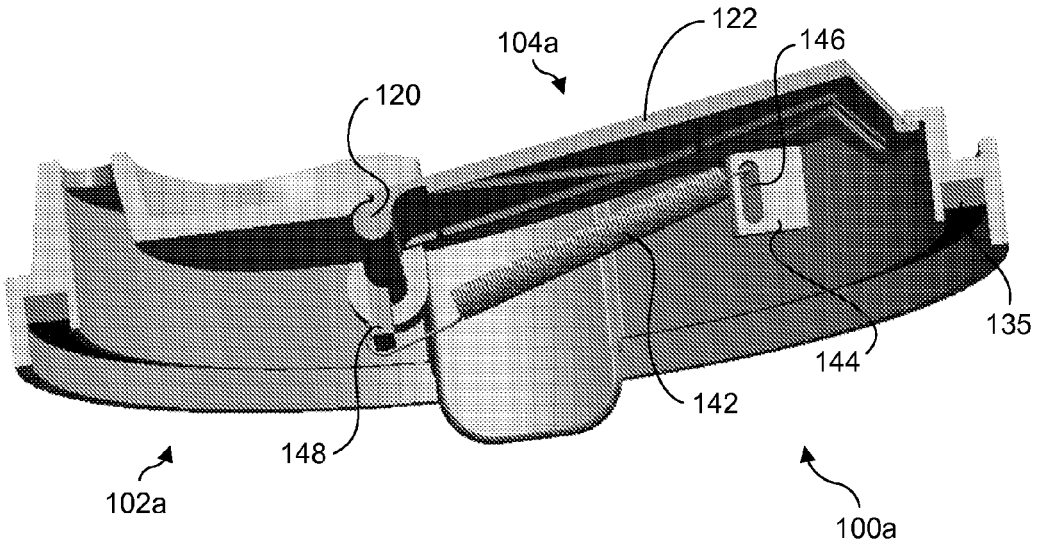
FIG. 7*a* is an isometric cross-section view illustrating an embodiment of a lid assembly employing a spring mechanism configured to bias the pivotable flap in a closed position.
Figure 7B:
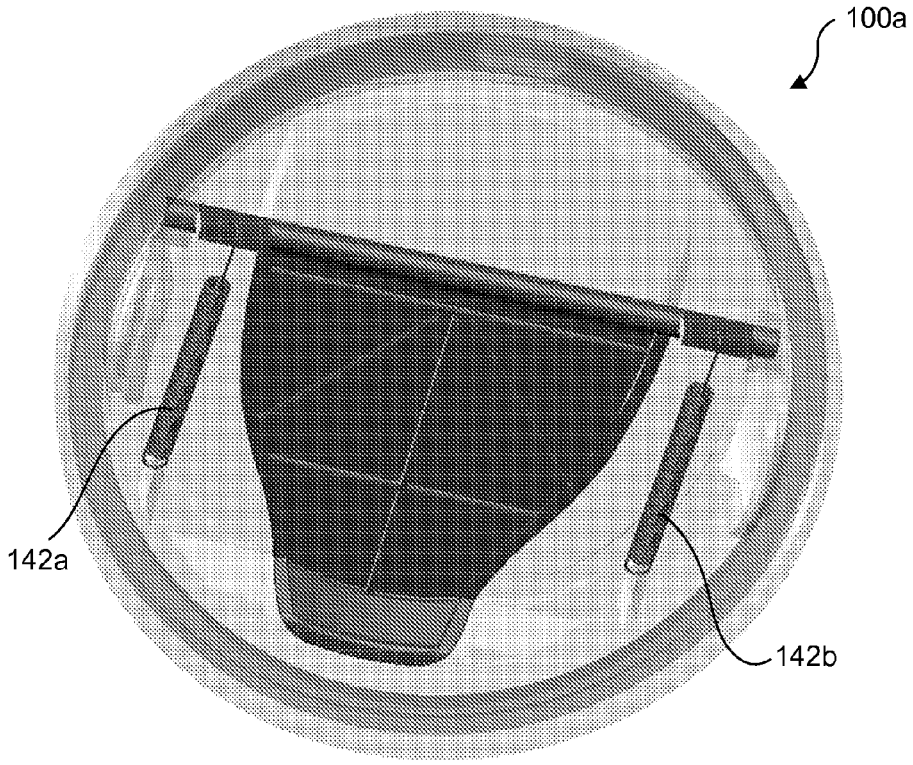
FIG. 7*b* is an underside isometric view of an embodiment of a lid assembly employing two springs to bias the pivotable flap in the closed position.

A cross-section of a second embodiment comprising a lid assembly 100*a* is shown in FIG. 7*a*. Lid assembly 100*a* includes a lid 102*a* to which a pivotable flap 104*a* is pivotally coupled and a biasing means comprising a spring 142 that is configured to bias the pivotable flap in a closed position. Lid 102*a* is generally similar in configuration to lid 102, with the addition of a member 144 having a slot 146 formed therein to which a rearward end of spring 142 is coupled, e.g., via a loop at the end of the spring. The other end of spring 142 is coupled to a member 148 extending from pivot rod 120. As shown in FIG. 7*b*, in one embodiment a similar spring mechanism including springs 142*a* and 142*b* are implemented on the both sides of lid 102*a*. The spring mechanisms are configured to apply a bias moment about the pivot axis that is opposite the moment about the pivot axis produced by cantilevered flap 122 due to gravity. As a result, cantilevered flap is biased toward a closed position. At the same time, the bias is preferably light enough so that when a beverage consumer presses his or her nose against the flap, the flap easily rotates. Thus, the consumer is able to tilt the beverage cup at a greater angle prior to having to tilt his or her head back (when compared to use of a conventional lid). In another embodiment, the spring element can be provided as a torsional spring with one end on the lid and the other end on the flap.

FIGS. 8*a*, 8*b*, and 8*c*, illustrated the pivoting movement of pivotable flap 104 relative to lid 102. As shown in FIG. 8*a*, when the lid is in a horizontal orientation relative to the gravity (G) axis, pivotable flap 104 is in a closed position under which a top of the flap is at an angle of X° relative to horizontal plane H, which is perpendicular to the gravity axis. As further shown, the center of gravity (CG) 800 of pivotable flap 104 is located at an angle of Y° relative to a vertical axis passing through axis 121 that is parallel to gravity axis G. As a result, the force of gravity acting through CG 800 generates a counter-clockwise moment (relative to the orientation shown in FIGS. 8*a-c*) about pivot axis 121, which creates an upward force F that is applied to the cantilevered portion of pivotable flap 104. In one embodiment angle Y is 10-15°; however, this is merely illustrative of one range of angles, as other angles may also be used. Preferably, angle Y should be at least a few degrees.

As lid 100 begins to be tilted counterclockwise (relative to the orientation shown in FIGS. 8*a-c*), pivotable flap 104 will remain in the closed position until the tilt angle exceeds angle Y. At this point, CG 800 will be directly below pivot axis 121, thus creating no moment about pivot axis 121. As a result, pivotable flap 104 will be at equilibrium under which the angle of the top of the cantilevered portion of pivotable flap 104 relative to horizontal is X°+Y°. As shown in FIGS. 8*b* and 8*c*, as lid 100 is tilted further in the counterclockwise direction, the orientation of pivotable flap 104 relative to horizontal plane H and gravity axis G remains the same.

In one embodiment, a damping mechanism can be added to the pivotable flap to dampen possible oscillations when the flap opens or when vibrations or shocks are transmitted to the beverage container to which the lid is coupled. For example and without limitation, the damping mechanism may comprise a viscous damping system that is operatively coupled to the pivot rod and/or counterweight(s). In one embodiment, a viscous damping member is operatively coupled toward one or both end portions of the pivot rod. In one embodiment, one or both pivot rod end portions are configured to mate with an internal ring of a bearing that is viscously dampened.

Figure 8D:
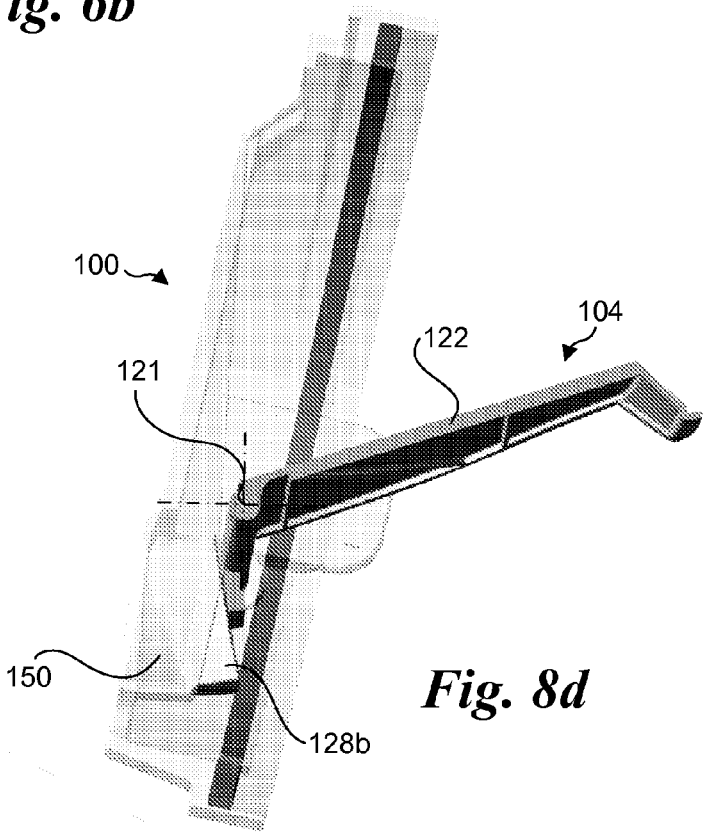
FIG. 8*d* is isometric cross-section view illustrating the counterweights occupying wells formed in the underside of the lid when the lid is tilted.
Figure 8A:
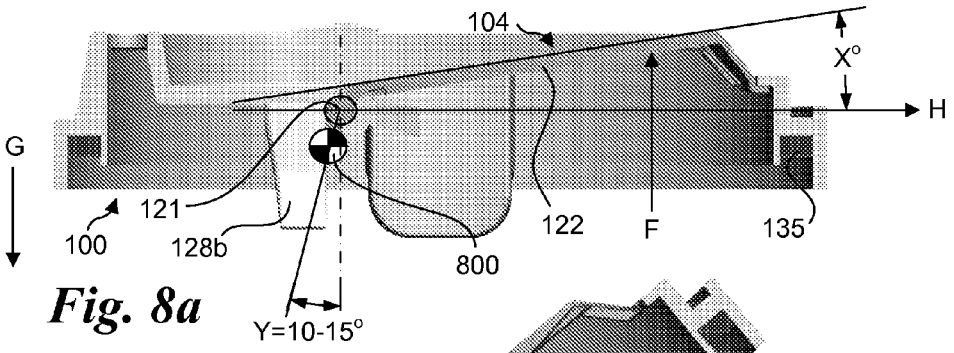
FIGS. 8*a*, 8*b*, and 8*c* are elevation cross-section views illustrating the pivoting of the pivotable flap and counterweights relative to the lid as the lid is tilted.
Figure 8B:
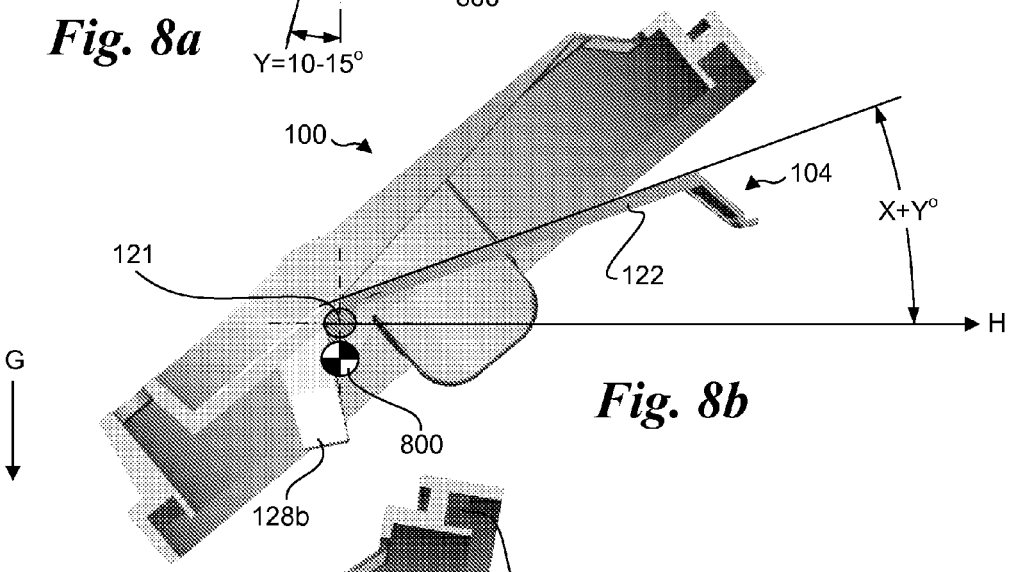
Figure 8C:
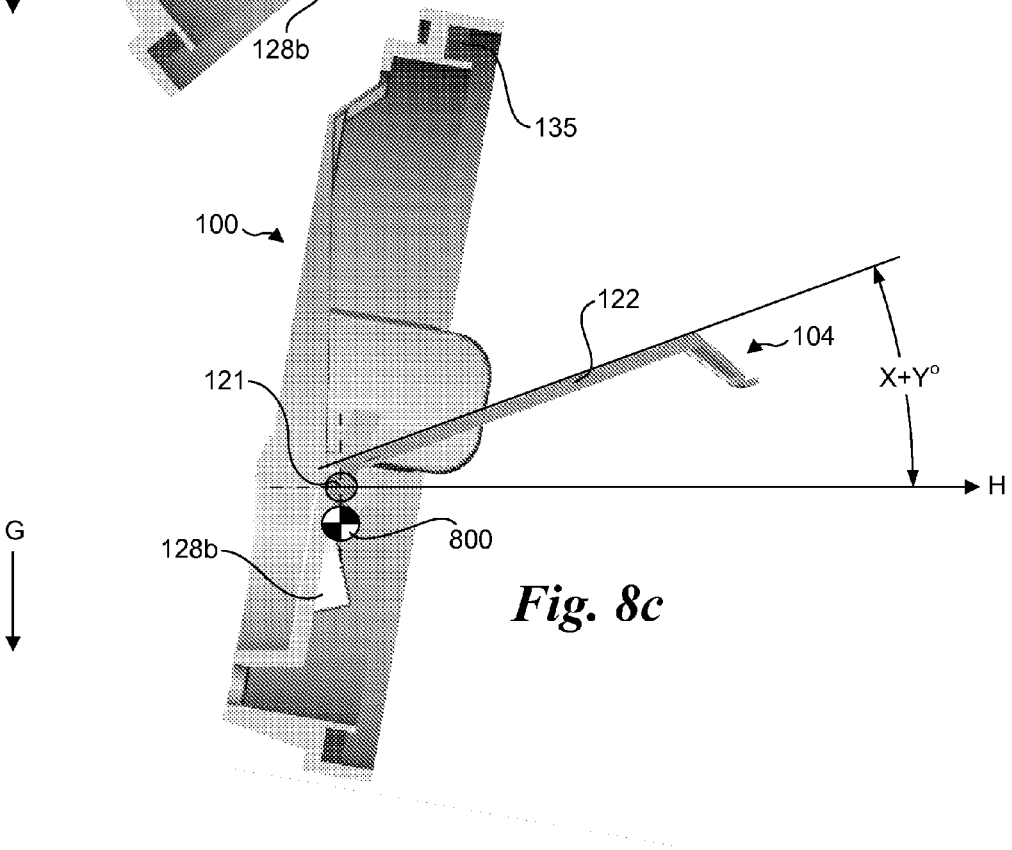

FIG. 8*d* shows isometric cross-section view of the full open configuration shown in FIG. 8*c*. As illustrated, the underside of the upraised and plateaued portion proximate to the counterweight 128*a* (not shown) and 128*b* is configured to form a pair of wells 150 that are sized to enable the counterweights to remain clear of lid 100 as the lid is tilted relative to the horizontal plane. In an alternatively embodiment, the wells housing counterweights 128*a* and 128*b* can be made in a concave up configuration so the counterweights are exposed on the upper side of the lid but are isolated from the beverage on the lower side of the lid.

Figure 9D:
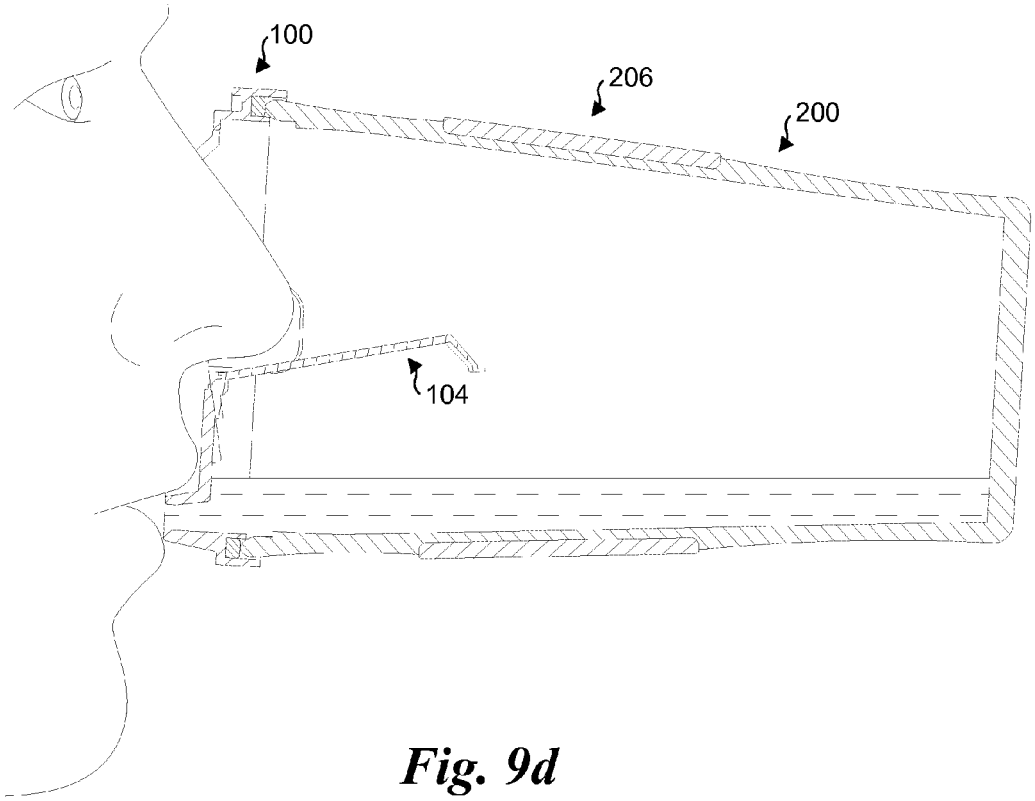
FIG. 9*d* shows a cross-section view illustrating the orientation of the pivotable flap relative to the lid and beverage contain, and relative to the nose of person consuming a beverage.

FIGS. 9*a*, 9*b*, and 9*c* illustrate the relative rotation of the cantilevered flap 122 relative to the lid assembly 100 and container 200 when the container is tilted to facilitate consumption of a beverage. As shown, the effect of the counterweights 128 is to counterbalance the clockwise moment that the cantilevered flap 122 creates about pivot axis 121 (which is substantially perpendicular to the page and passes through the illustrated cross-hairs depicted in FIGS. 8*a* thru 8*c*) as well as to provide a stable close position and a convenient opening position by properly positioning the center of gravity below and front of the pivot axis (in closed, horizontal position) as previously explained. As a result, once the flap opens relative to the lid, the angle of the cantilevered flap relative to the vertical gravity axis 'G' remains substantially the same regardless of the orientation of container 200 relative to gravity. As shown in FIG. 9*d*, this enables the container to be tilted at a greater angle during beverage consumption without requiring the consumer to tilt his or her head back as far as would be required with a conventional lid.

The container 200 is further depicted as including a sleeve 206 around the waist of the container. Generally, ridges 204 are configured to form air compartments between the container and sleeve 206 in order to provide for a better thermal insulation for holding the container. In one embodiment, sleeve 206 is a permanently installed sleeve made of a resilient (but still flexible) material.

Figure 10A:
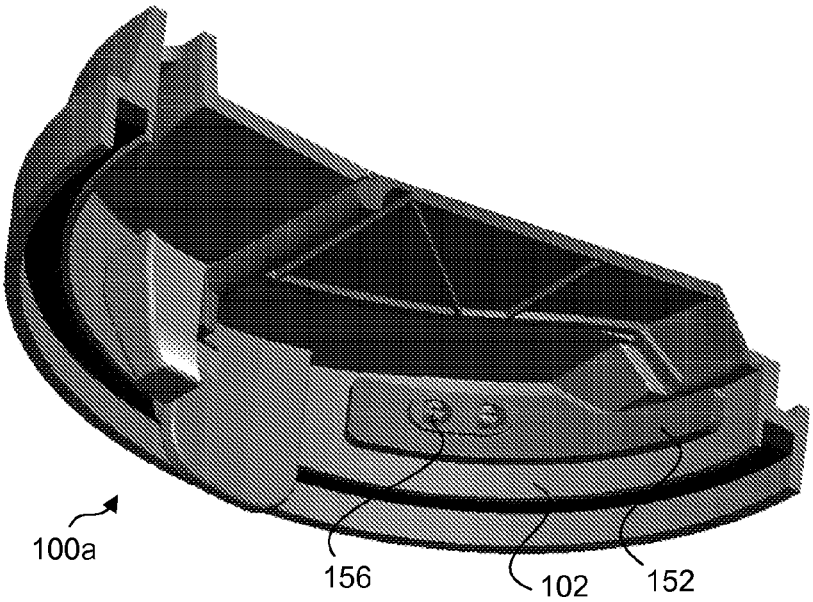
FIGS. 10*a-d* show underside cross-section and topside isometric views of a lid assembly including a latching mechanism to enable the pivotable flap to be latched in the closed position.
Figure 10B:
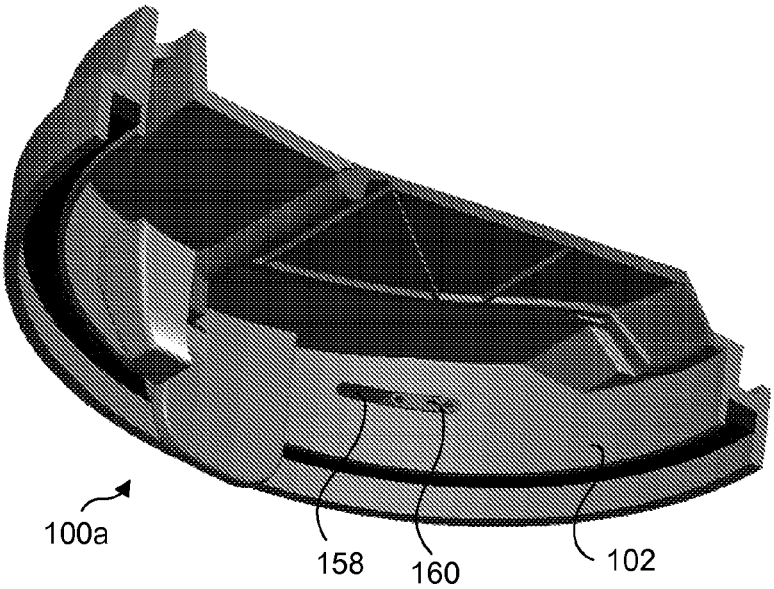
Figure 10C:
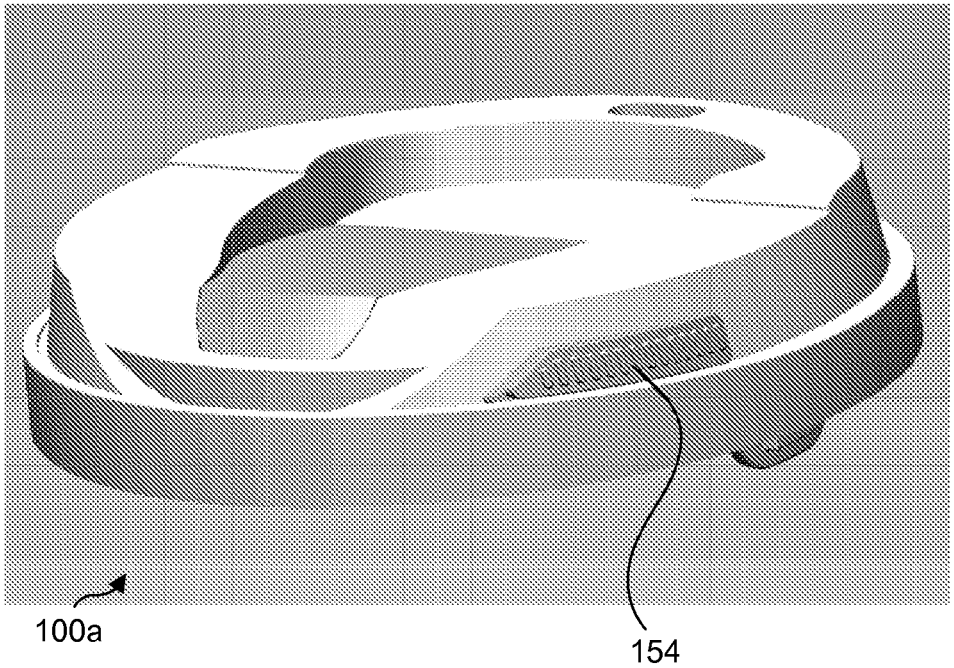
Figure 10D:
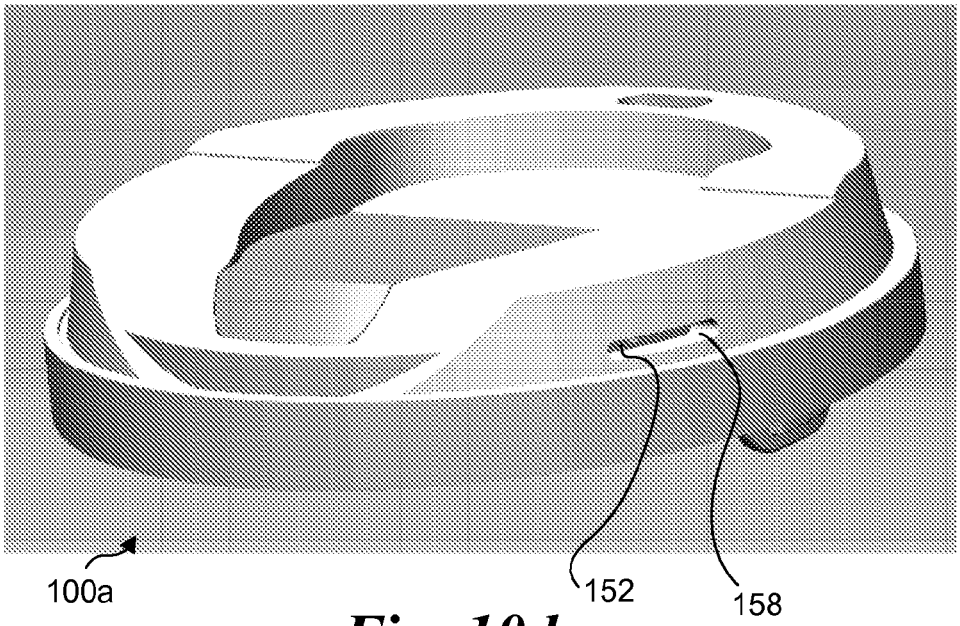

In one embodiment, a latching mechanism is added to enable a user to latch pivotable flap 104 in the closed position. In the embodiment illustrated in FIGS. 10*a-d*, the latching mechanism includes an inward latching member coupled to an external latch via any of various suitable coupling means, such as via one or more fasteners 156 (as shown), via an adhesive or other bounding technique, etc. A slot 158 is formed in the sidewall of lid 102, and a protrusion 160 extending from one of exterior latch 154 (as shown in FIG. 10*c*) or internal latching member 152 is configured to engage the upper and lower walls of the slot. By sliding exterior latch 154 toward the rear of lid 102 when pivotable flap 122 is in the closed position, the pivotable flap can be latched in the closed position, enabling a full or nearly full beverage container with lid assembly 100 to be tilted without spillage. For example, use of the latching mechanism may be advantageous when the beverage container is placed in a vehicle cup holder during a rough ride, or when a consumer is holding the beverage container while running or transportation that may involved very brisk movements or more than normal tilting. Methods as known in the art can also be used to cover the drinking spout in these situations.

Figure 11:
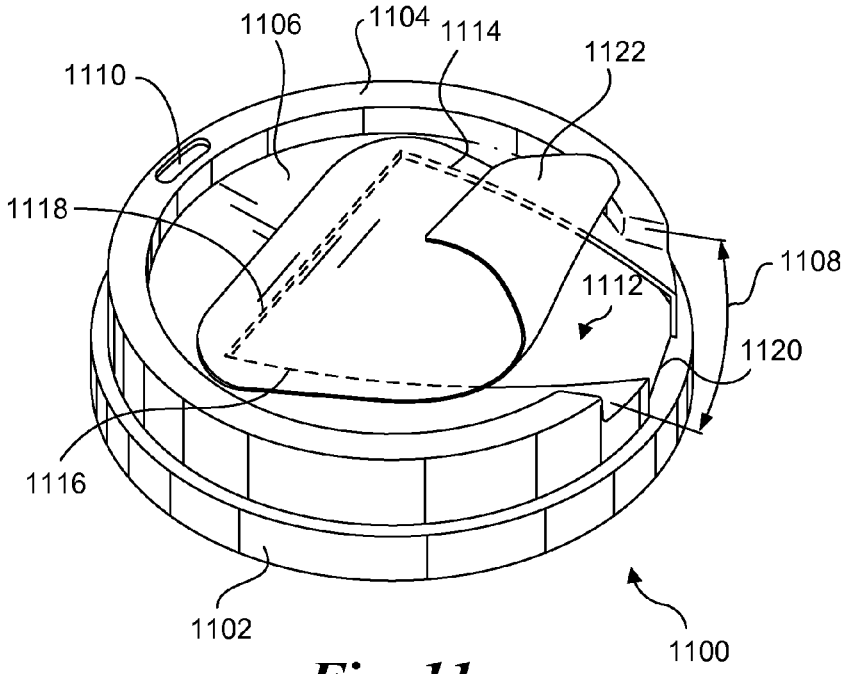
FIG. 11 is a topside isometric view of a coffee cup lid including a cover that may be peeled back or removed to expose an aperture defined toward a rear of the lid, according to one embodiment.

FIG. 11 illustrates an embodiment of a lid 1100. Generally, lid 1100 may be manufactured to be a disposable lid or a reusable lid, depending on the targeted use and the materials employed. As shown, lid 1100 has a generally circular body having a skirt 1102 extending downward therefrom and configured to engage a lip of a coffee cup (not shown). An annular raised portion 1104 is disposed proximate to a periphery of the circular body so as to define a well having a floor 1106. As illustrated, in one embodiment the annular raised portion 1104 has a break 1108 toward a rear portion of the lid such that it does not extend all of the way around the circular body of lid 1100. An orifice 1110 through which the beverage is consumed is defined in annular raised portion 1104 toward a front portion of lid 1100 and opposite break 1108. An aperture 1112 including sides 1114 and 1116, a forward edge 1118, and a rear edge 1120 is defined through a rear portion of floor 1106, as illustrated, leaving a shelf defined in a front portion of the floor 1106 and along the sides 1114 and 1116 of aperture 1112.

A cover 1122 is configured to cover aperture 1112 to seal the aperture to prevent spillage. However, cover 1122 may also be peeled back to expose aperture 1112 to enable easier beverage consumption once a portion of the beverage has been consumed (or optionally, once the spillage prevention feature is no longer needed). Note that, keeping the lid on even with the foil removed, provides enhanced rigidity to a cup made out of very flexible material like paper than when the lid is not attached. In one embodiment, cover 1122 may be configured to be completely removed. In various embodiments, cover 1122 may comprise a foil or similar material (e.g. when implemented as a disposable lid), or a real or synthetic rubber, or other resilient material (e.g., when implemented for a reusable lid). In one embodiment, the material for cover 1122 has an inherent tackiness, facilitating a seal proximate to sides 1114 and 1116, forward edge 1118 and rear edge 1120 of aperture 1112. Optionally, an adhesive may be applied proximate to sides 1114 and 1116 (and optionally one or both of forward edge 1118 and rear edge 1120), or an adhesive may be applied along all or selected portions of the periphery of cover 1122. Preferably, such an adhesive will provide enough tackiness to seal cover 1122 proximate to the periphery of aperture 1112, while enabling the cover to be peeled back and/or completely removed.

Figure 12:
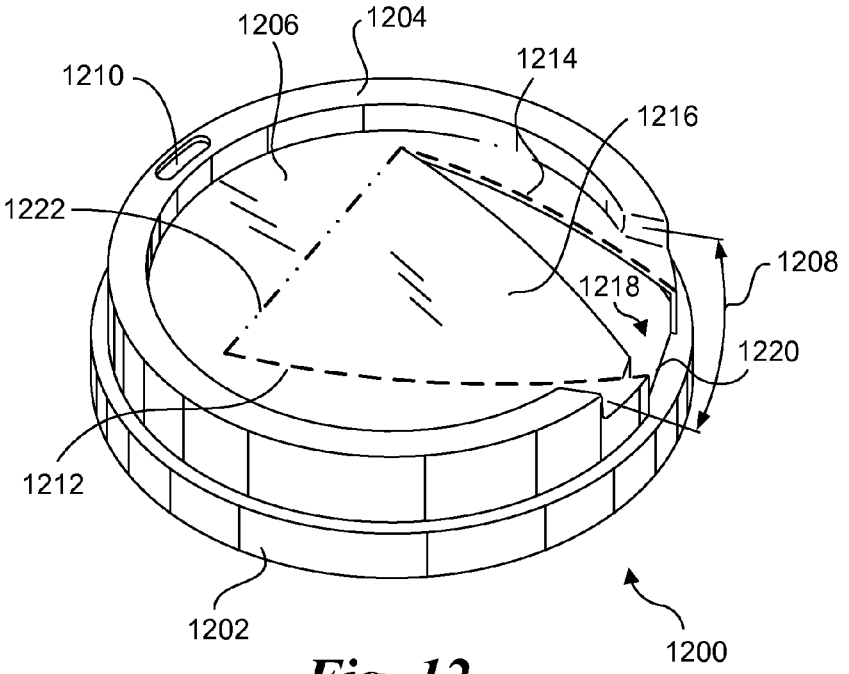
FIG. 12 is a topside isometric view of a coffee cup lid including perforations in a floor of the lid to facilitate creation of a flap and/or aperture in the lid, according to one embodiment.

An embodiment of a disposable lid 1200 is shown in FIG. 12. The configuration of disposable lid 1200 is generally similar to disposable lid 1100 and includes a generally circular body having a skirt 1202 extending downward therefrom and configured to engage a lip of a coffee cup (not shown). An annular raised portion 1204 is disposed proximate to a periphery of the circular body so as to define a well having a floor 1206. As illustrated, in one embodiment the annular raised portion 1204 has a break 1208 toward a rear portion of the lid such that it does not extend all of the way around the circular body of lid 1200. An orifice 1210 through which the beverage is consumed is defined in annular raised portion 1204 toward a front portion of lid 1200 and opposite break 1208. Parting lines 1212 and 1214 are shown in floor 1206 to illustrate that under the unused configuration floor 1206 is intact, and disposable lid 1200 functions as a conventional disposable lid. However, perforations or the like are defined in floor 1206 coincident with parting lines 1212 and 1214, enabling the consumer to push down the rear portion of the floor to create a flap 1216, which also results in creating an aperture 1218. In one embodiment, a perforated edge 1220 is defined at the rear of lid 1200; optionally, a slit may be defined along edge 1220. In one embodiment, the thickness of floor 1206 along fold line 1222 is reduced or specifically profiled to simulate a hinge line enabling flap 1216 to be rotated more easily about fold line 1222.

The configuration of disposable lid 1200 may be augmented to support additional functionality. For example, an upward extending tab (not shown) may be formed toward the rear edge of flap 1216, and the portion of floor 1206 along fold line 1222 may be either perforated or may comprise a slit. Under this configuration, the consumer may pull on the tab and remove flap 1216.

Figure 13A:
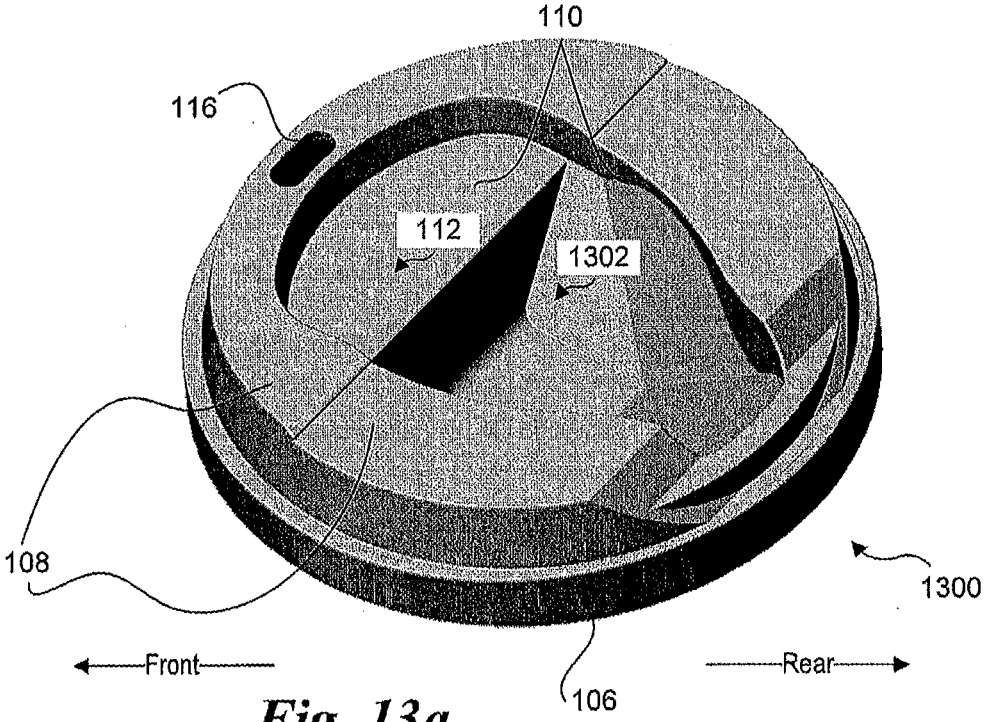
FIGS. 13*a* and 13*b* respectively show topside and underside isometric views of a lid configured with a cavity space to accommodate a consumer's nose.
Figure 13B:
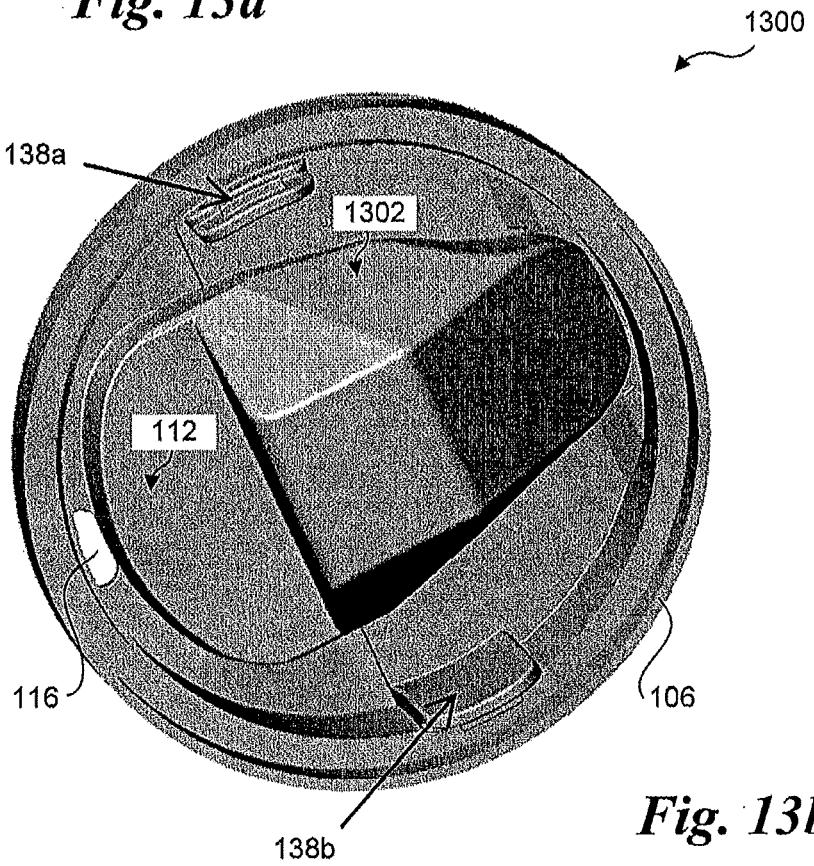
Figure 13C:
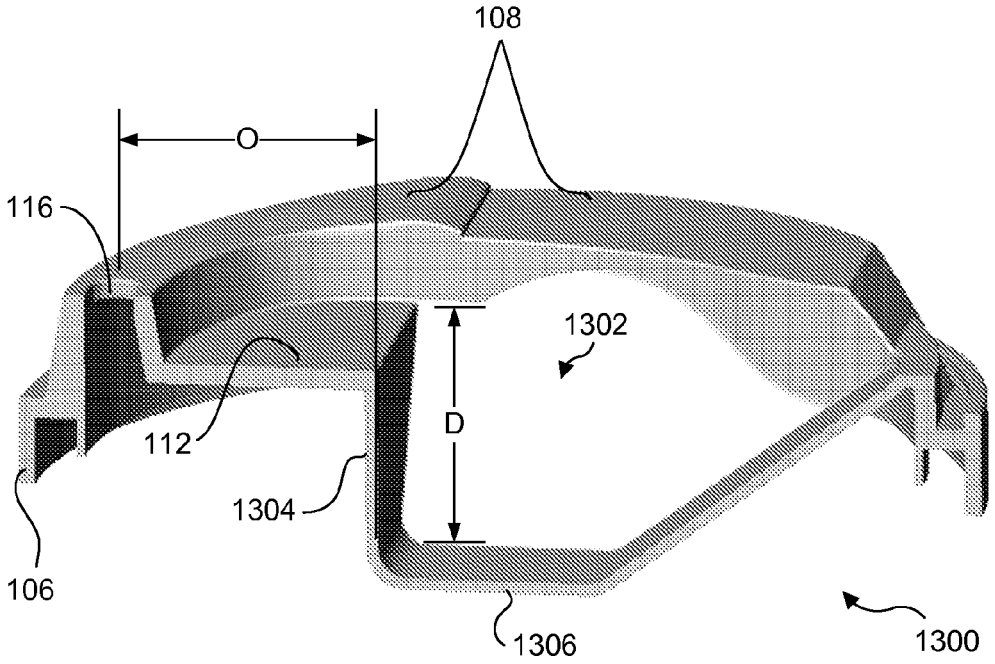
FIG. 13*c* shows an isometric cross-section view of the lid of FIGS. 13*a* and 13*b*.

In another embodiment, the nose is accommodated by providing a cavity in a rearward portion of the lid. For example, topside and underside isometric views of a lid 1300 configured with a cavity 1302 to accommodate a consumer's nose is shown in FIGS. 13*a* and 13*b*, while a cross-section view is shown in FIG. 13*c*. The portion of lid 1300 not including cavity space 1302 is similar to the configuration of lid 102 shown in various figures herein and discussed above. Accordingly, as before, lid 1300 is generally circular in shape and includes a skirt 106 extending downward from a generally raised and plateaued area 108 formed around the periphery of the lid in which a well 110 is formed. As illustrated, in some embodiments that height of the raised area is reduced toward the rear of lid 1300. Cavity 1302 is formed in a rearward portion of well 110, leaving a shelf 112. Lid 102 also includes an orifice 116 formed in the front portion of raised area 108 through which the beverage is consumed. Preferably, the depth of the cavity replicates the shape of a common human nose sized to fit a majority of human noses. Optionally, it is possible to have such cavities of different size: small, medium, large.

In order to minimize spills, proper room should be provided in all directions around the periphery to accommodate liquid movement when the mug is tilted. In the illustrated embodiment shown in FIG. 13*c*, the cavity is deepest at a frontward wall 1304 with a vertical distance (depth D) at an offset O approximately 1.0 inch from the location of the orifice 116. Adjacent to frontward wall 1304 is a floor 1306, and then the depth of cavity 1302 becomes progressively shallower toward the rear of the lid, ending somewhere above where the top edge of the cup would be when the lid is fully attached. In addition, the sidewalls of cavity 1302 are generally angled a small amount relative to vertical, as illustrated in FIGS. 13*a* and 13*b*. In the illustrated embodiment the rear cavity ends at approximately ¼ inches below the top level of the cup (not shown). The side walls of the cavity narrow down as you go down from the top. The area of the horizontal cross section of the cavity is reduced by shaping the cavity to follow the normal nose anatomy. In order to accommodate most nose sizes and their position relative to the lips, the lid needs to be configured with appropriate dimensions. For example, the lid in the current embodiment is design for adult users and has an exterior diameter of 3.6 inches.

Preferably, a lid with a cavity should be configured such that there is sufficient nose clearance under the lid while not increasing (or increasing a minimal amount of) the overall height of the lid and mug/coffee cup when the lid is installed. Since the cavity is below the nominal top of the lid (when compared with a conventional coffee cup lid), when the lid is installed in a full cup of coffee or other beverage, a portion of the beverage may be displaced, flowing into the volume between the inside of the periphery of the lid and the exterior of the cavity. Preferably, the exterior sidewalls extend down below the nominal height of the displaced beverage such that the sidewalls seal the cup lid during the installation process prior to the beverage height exceeding the rim of the container. In addition, if the top of orifice 116 is sufficiently above the level of the beverage when the lid is installed on the beverage container, the container may be tilted a small amount without spilling any of the beverage out of the orifice 116.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

For example, the spring mechanism used for a rigid flap can be replaced by using the elasticity of the flap material itself. In one embodiment, a flap made of an elastic material can be rigidly attached to the front side of the aperture of a reusable traveling mug similar to the one depicted in FIG. 2*a*. The flap will then function similar to the disposable lid in FIG. 12 where the front edge of the flap forms an elastic constraint that allows the flap to open when pressed down and closing it when the pressure is removed. Here, the whole flap will bend down either predominantly at the root if a hinge configuration is designed or by a continuous deformation of an elastic flap construction. In yet another configurations, elastic flaps made of a rubber like material can be rigidly attached to any number of sides of the aperture so that there can be two or more flaps (lobes) that are bent down when a nose pressure on them.

In another embodiment, the lid has an aperture covered by a stretchable membrane. As the mug is tilted, the nose will come into contact with the membrane which, by stretching, will let the nose pass through the aperture. In yet another embodiment, a motor actuated flap is designed in which a position sensor senses the tilt of the mug and rotates the flap in an open position. Alternatively, a sensor can sense the position of the flap and send the signal to a control circuitry to prevent the flap from tilting. Using a motor can be used in conjunction with the counterweights to minimize actuation energy.

These modifications can be made to the invention in light of the above detailed description. The terms used in the following claims should not be construed to limit the invention to the specific embodiments disclosed in the specification and the drawings. Rather, the scope of the invention is to be determined entirely by the following claims, which are to be construed in accordance with established doctrines of claim interpretation.

What is claimed is:

1. An assembly, comprising:

a lid having an orifice defined in a front portion of the lid, an aperture defined toward a rear portion, the orifice and aperture aligned along a first axis, and a pair of pivot mounts defining a pivot axis substantially perpendicular to the first axis; and a pivotable flap, having a cantilevered flap coupled to a pivot rod and including at least one counterweight coupled to the pivot rod, wherein the pivot rod includes a pair of rod end portions that are configured to be received by the pivot mounts upon assembly, wherein the cantilevered flap is caused by gravity to rotate to a closed position when the lid is rotated to a horizontal orientation perpendicular to a gravity axis, and wherein the cantilevered flap is caused by gravity to rotate to an open position when the front portion of the lid is tilted downward relative to the rear portion of the lid.

2. The assembly of claim 1, wherein a peripheral portion of the cantilevered flap is configured to engage an inner peripheral underside portion of the aperture when the flap is in the closed position, and wherein a plane coincident with a top surface of the cantilevered flap remains at substantially the same angle relative to the gravity axis as the front portion of the lid is tilted downward relative to the rear portion of the lid at an increasing angle relative to the gravity axis.

3. The assembly of claim 1, wherein the lid further comprises:

an upraised and plateaued portion disposed proximate to a periphery of the lid forming a well having a rearward portion through which the aperture is defined, leaving a shelf toward the front portion of the lid.

4. The assembly of claim 3, wherein the at least one counterweight comprises a pair of counterweights, each disposed proximate to a respective rod end, wherein a portion of each counterweight hangs down below the pivot axis when the pivotable flap is in the closed position and the upraised and plateaued portion is configured to form a pair of wells in an underside of the lid that are sized to enable the counterweights to swing into the wells as the lid is tilted downward relative to the rear portion of the lid.

5. The assembly of claim 1, wherein the cantilevered flap includes a tongue extending toward the rear portion of the lid, wherein the tongue and rear portion of the lid are configured such that a periphery of the tongue engages an underside of the rear portion of the lid when the lid is in a horizontal orientation relative to the gravity axis.

6. The assembly of claim 1, wherein the pivotable flap has a center of gravity that is below a pivot axis about which the pivotable flap pivots, and an angle between a line passing through the pivot axis and the center of gravity is approximate 10-15 degrees relative to the gravity axis when the lid is in a horizontal orientation.

7. The assembly of claim 1, further comprising a latch mechanism having a latched position under which the cantilevered flap is latched in a closed position and an unlatched position under which the cantilevered flap is enabled to pivot about the pivot axis.

8. The assembly of claim 1, further comprising a beverage container, wherein the lid is configured to be secured to a top portion of the beverage container.

9. The assembly of claim 8, wherein the top portion of the beverage container includes an internal thread, and the lid includes first and second downward-extending tabs, each having a protrusion configured to fit within the internal thread and oriented such that the lid can be screwed onto the top of the beverage container.

10. The assembly of claim 8, further comprising an annular lid gasket, wherein the lid has an annular grove formed in its underside and the beverage container has an annular rim, and wherein upon assembly of the lid to the beverage container the annular lid gasket engages the annular grove in the lid and the annular rim of the beverage container.

11. The assembly of claim 8, wherein the beverage container includes a waist portion having a plurality of vertical ridges formed therein.

12. An assembly, comprising:

a lid having an orifice defined in a front portion, an aperture defined toward a rear portion, the orifice and aperture aligned along a first axis, and a pair of pivot mounts defining a pivot axis substantially perpendicular to the first axis;

a pivotable flap, having a cantilevered flap coupled to a pivot rod, wherein the pivot rod includes a pair of rod end portions that are configured to be received by the pivot mounts upon assembly; and at least one spring, operatively coupled to the pivotable flap, producing a moment about the pivot axis to cause the cantilevered flap to be rotated to a closed position under which a peripheral portion of the cantilevered flap is configured to engage an inner peripheral underside portion of the aperture.

13. The assembly of claim 12, wherein the cantilevered flap includes a tongue extending toward the rear portion of the lid, wherein the tongue and rear portion of the lid are configured such that a periphery of the tongue engages an underside of the rear portion of the lid when the cantilevered flap is rotated to the closed position.

14. The assembly of claim 12, wherein the at least one spring comprises a pair of coil springs, each having a first end operatively coupled to a member disposed toward a rear of the lid and second end operatively coupled to a member coupled to the pivot rod proximate to a respective rod end.

15. The assembly of claim 12, wherein the at least one spring comprises at least one torsional spring.

16. The assembly of claim 12, further comprising a beverage container, wherein the lid is configured to be secured to a top portion of the beverage container.

17. The assembly of claim 16, wherein the beverage container includes a waist portion having a plurality of vertical ridges formed therein.

* * * * *